US007527199B2

(12) United States Patent
Quine et al.

(10) Patent No.: US 7,527,199 B2
(45) Date of Patent: May 5, 2009

(54) METHOD AND SYSTEM FOR PROTECTING PRIVACY OF SIGNATURE ON MAIL BALLOT UTILIZING OPTICAL SHUTTER

(75) Inventors: Douglas B. Quine, Bethel, CT (US); Frederick W. Ryan, Jr., Oxford, CT (US)

(73) Assignee: Pitney Bowes Inc., Stamford, CT (US)

( * ) Notice: Subject to any disclaimer, the term of this patent is extended or adjusted under 35 U.S.C. 154(b) by 347 days.

(21) Appl. No.: 11/521,678

(22) Filed: Sep. 15, 2006

(65) Prior Publication Data

US 2008/0121680 A1 May 29, 2008

(51) Int. Cl.
*G06K 17/00* (2006.01)
*G06K 19/06* (2006.01)

(52) U.S. Cl. ..... 235/386; 235/492; 235/441; 235/462.25

(58) Field of Classification Search ..... 235/493, 235/368, 462.25, 375, 381, 383–385, 487, 235/491–492, 441; 705/406; 40/455; 399/312
See application file for complete search history.

(56) References Cited

U.S. PATENT DOCUMENTS 4,597,591 A 7/1986 Gendron et al.
4,703,573 A * 11/1987 Montgomery et al. ..... 40/455
5,015,318 A 5/1991 Smits et al.
5,288,994 A 2/1994 Berson
5,294,470 A 3/1994 Ewan
5,629,760 A * 5/1997 Hayashi et al. ..... 399/312
5,811,792 A 9/1998 Verschuur et al.
5,929,415 A * 7/1999 Berson ..... 235/382
6,202,929 B1 * 3/2001 Verschuur et al. ..... 235/462.25
6,447,015 B1 9/2002 Linnewiel
7,240,835 B2 7/2007 Brucker et al.
2002/0130777 A1 * 9/2002 Besnard ..... 340/568.7
2005/0061866 A1 3/2005 Ackley et al.
2007/0095908 A1 * 5/2007 Haas et al. ..... 235/386
2008/0136162 A1 6/2008 Haas et al.
2008/0142594 A1 6/2008 Haas et al.
2008/0143096 A1 6/2008 Haas et al.
2008/0156862 A1 7/2008 Haas et al.

* cited by examiner

*Primary Examiner*—Thien Minh Le
*Assistant Examiner*—Sonji Johnson
(74) *Attorney, Agent, or Firm*—Brian A. Lemm; Angelo N. Chaclas

(57) ABSTRACT

Methods and systems that protect the privacy of signatures on envelopes containing ballots sent through the mail are provided. The envelope for returning ballots by mail includes an electronic optical shutter that covers an opening in the flap of the envelope. The voter signs the back of the envelope in an area that will be visible through the opening in the flap (covered by the optical shutter) when the envelope flap is sealed. The optical shutter is opaque under static conditions, but will become transparent when power is supplied to it. When the envelope flap is sealed and no power is applied to the optical shutter, the voter's signature will be concealed by the optical shutter. Upon receipt at the registrar's office, the optical shutter can be powered, thereby rendering the optical shutter transparent, and the voter's signature can be viewed.

15 Claims, 4 Drawing Sheets

METHOD AND SYSTEM FOR PROTECTING PRIVACY OF SIGNATURE ON MAIL BALLOT UTILIZING OPTICAL SHUTTER

FIELD OF THE INVENTION

The invention disclosed herein relates generally to voting systems, and more particularly to a method and system for protecting privacy of signatures on ballots sent through the mail.

BACKGROUND OF THE INVENTION

In democratic countries, governmental officials are chosen by the citizens in an election. Conducting an election and voting for candidates for public office in the United States can be performed in several different ways. One such way utilizes mechanical voting machines at predetermined polling places. When potential voters enter the predetermined polling place, voting personnel verify that each voter is properly registered in that voting district and that they have not already voted in that election. Thus, for a voter to cast his vote, he must go to the polling place at which he is registered, based on the voter's residence. Another method for conducting an election and voting utilizes paper ballots that are mailed to the voter who marks the ballot and returns the ballot through the mail. Mailed ballots have been historically reserved for absentee voting. In the usual absentee voting process, the voter marks the ballot to cast his/her vote and then inserts the ballot in a return envelope which is typically pre-addressed to the voter registrar office in the corresponding county, town or locality in which the voter is registered. The voter typically appends his/her signature on the back of the envelope adjacent his/her human or machine readable identification.

When the return envelope is received at the registrar's office, a voting official compares the voter signature on the envelope with the voter signature retrieved from the registration file to make a determination as to whether or not the identification information and signature are authentic and valid, and therefore the vote included in the envelope should be counted. If the identification information and signature are deemed to be authentic and valid, the identifying information and signature are separated from the sealed ballot before it is handed to the ballot counters for tabulation. In this manner, the privacy of the voter's selections is maintained and thus the ballot remains a "secret ballot."

One general problem with vote by mail envelopes is the signature is in the open and exposed for all to see throughout the process for determining whether or not the vote is authentic. This leads to potential privacy issues and concerns, e.g., fraudulent usage of a voter's signature. Some jurisdictions have required that such signatures be hidden from plain sight while the envelope is en route from the voter to the registrar's office. This will protect against easy imaging of the signature, such as, for example, with a hand scanner or digital camera, for later impersonation or other fraudulent purposes, e.g., identity theft. To comply with such requirements, envelopes have been proposed that hide the signature with a flap which is removed when the envelope is received at the registrar's office. These solutions, however, require some mechanical manipulation of the envelopes, which is both expensive and increases the risk of accidental tears of the envelope, potentially leading to damage to the ballots contained in the envelopes and subsequently errors in the counting of votes.

Voting by mail is becoming more prevalent, apart from the usual absentee voting, and in some jurisdictions, entire elections are being conducted exclusively by mail. As the voting by mail becomes more prevalent, the privacy concerns are also more prevalent. Thus, there exists a need for efficient methods and systems that can protect the privacy of signatures on ballots sent through the mail while also reducing the risk of damage to the ballots when the signatures are revealed.

SUMMARY OF THE INVENTION

The present invention alleviates the problems associated with the prior art and provides methods and systems that protect the privacy of signatures on ballots sent through the mail while also reducing the risk of damage to the ballots when the signatures are revealed.

In accordance with the present invention, the envelope for returning ballots by mail includes an electronic optical shutter that covers an opening in the flap of the envelope. The voter signs the back of the envelope in an area that will be visible through the opening in the flap (covered by the optical shutter) when the envelope flap is sealed. The optical shutter is opaque under static conditions, but will become transparent when appropriate power is supplied to it. Thus, when the envelope flap is sealed and no power is applied to the optical shutter, the voter's signature will be concealed by the optical shutter. Upon receipt at the registrar's office (or other official vote tallying location), the optical shutter can be powered, thereby rendering the optical shutter transparent, and the voter's signature can be viewed for comparison with the official records to perform the required signature verification to determine validity and authenticity of the ballot. Preferably, the envelope flap is provided with conductive power rails that will allow power to be supplied to the optical shutter while the envelope is being processed by automated mail processing equipment. Thus, while the envelope is en route from the voter to the registrar's office, the voter's signature will be concealed from plain view. Viewing of the signature does not require any mechanical manipulation of the envelope or flaps on the envelope, thereby reducing the processing cost and the risk of causing damage to the ballot contained therein. After verification of the voter's signature, the ballot can be separated from the envelope and provided to the ballot counters for tabulation. Optionally, the optical shutter can be reused on subsequent envelopes.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION OF THE PRESENT INVENTION

Figure 1:
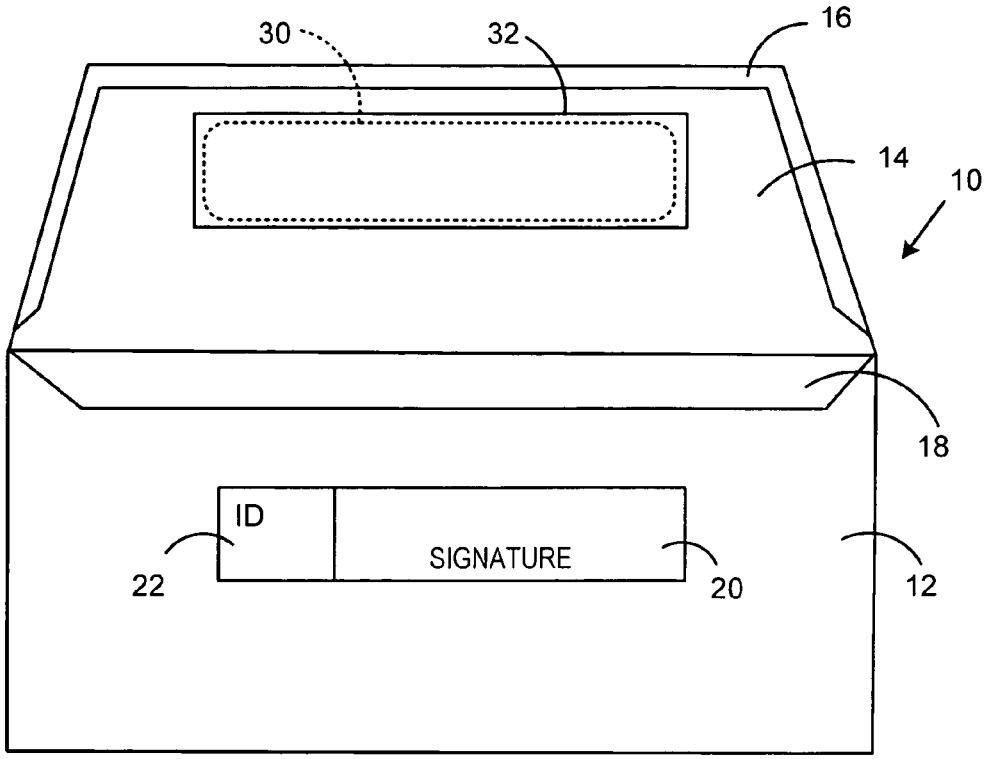
FIG. 1 illustrates an envelope for returning ballots by mail according to an embodiment of the present invention in an open position.
Figure 2:
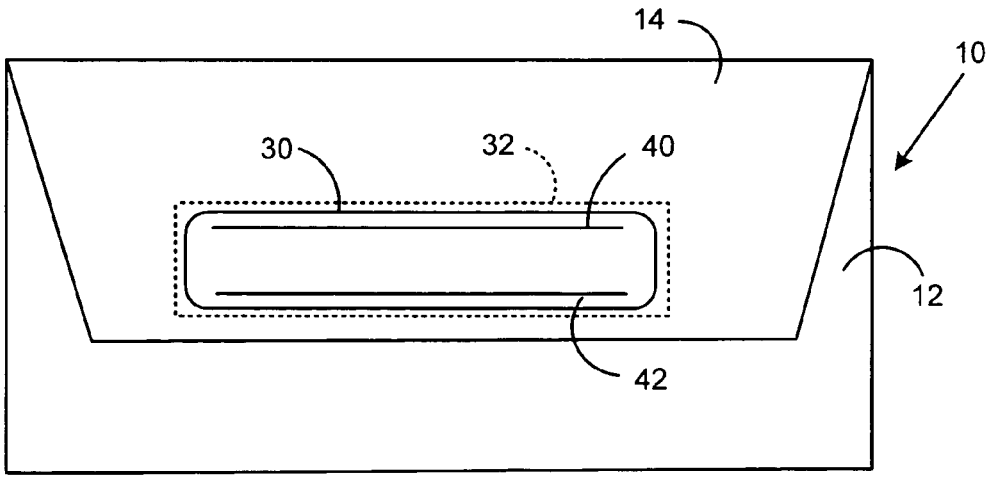
FIG. 2 illustrates the envelope of FIG. 1 in a closed position.

In describing the present invention, reference is made to the drawings, wherein there is seen in FIG. 1 an envelope 10 for returning ballots by mail according to an embodiment of the present invention in an open position. While the present description is directed to an envelope for returning ballots by mail, it should be understood that the invention is not so limited and the envelope 10 could be used to hold any type of communication or material. Envelope 10 includes a body portion 12 and a flap portion 14 connected to the body portion 12. When the flap portion 14 is in an open position as illustrated in FIG. 1, contents, such as, for example, a ballot, can be inserted into a pocket 18 formed by the body portion 12. The flap portion 14 can then be moved to a closed position (as illustrated in FIG. 2), and sealed utilizing a glue or sealing strip 16 which when activated will adhere the flap portion 14 to the body portion 12, thereby covering the pocket 18 and preventing the contents therein from falling out.

The body portion 12 is provided with an area 20 intended for the voter's signature along with an area 22 in which information that identifies the voter is provided. Such information can include, for example, the voter's name and address, and is preferably provided in some machine readable form such as a barcode. The identification information is preferably preprinted on the body portion 12 of the envelope 10, or alternatively may be preprinted on an adhesive label that the voter applies to the body portion 12 in the area 22.

The flap portion includes an opening 30 (indicated by the dashed lines in FIG. 1) that corresponds with the areas 20, 22 of the body portion when the flap portion 14 is in the closed position. An optical shutter 32 is placed such that the optical shutter 32 covers the opening 30. As shown in FIG. 2, when the flap portion 14 is folded over the body portion 12, the optical shutter 32 covers the areas 20, 22 on the body portion 12 of the envelope 10. Since the sealing strip 16 preferably extends along the sides of the flap portion 14, access to the areas 20, 22 is prevented through the side of the flap portion 14. The optical shutter 32 has two states, transparent and opaque. When the optical shutter 32 is opaque, it will conceal the information contained in the areas 20, 22 on the body portion 12 of the envelope 10. When the optical shutter 32 is transparent, the information contained in the areas 20, 22 of the body portion 12 is not concealed and can be read (through the opening 30 and optical shutter 32). An example of an optical shutter 32 is a liquid crystal display shutter, such as is available from Liquid Crystal Technologies, Cleveland, Ohio. The state of the optical shutter 32 is changed by applying voltage to the optical shutter 32, preferably through a pair of conductive traces, such as, for example, conductive rails 40, 42, as described below.

Figure 3:
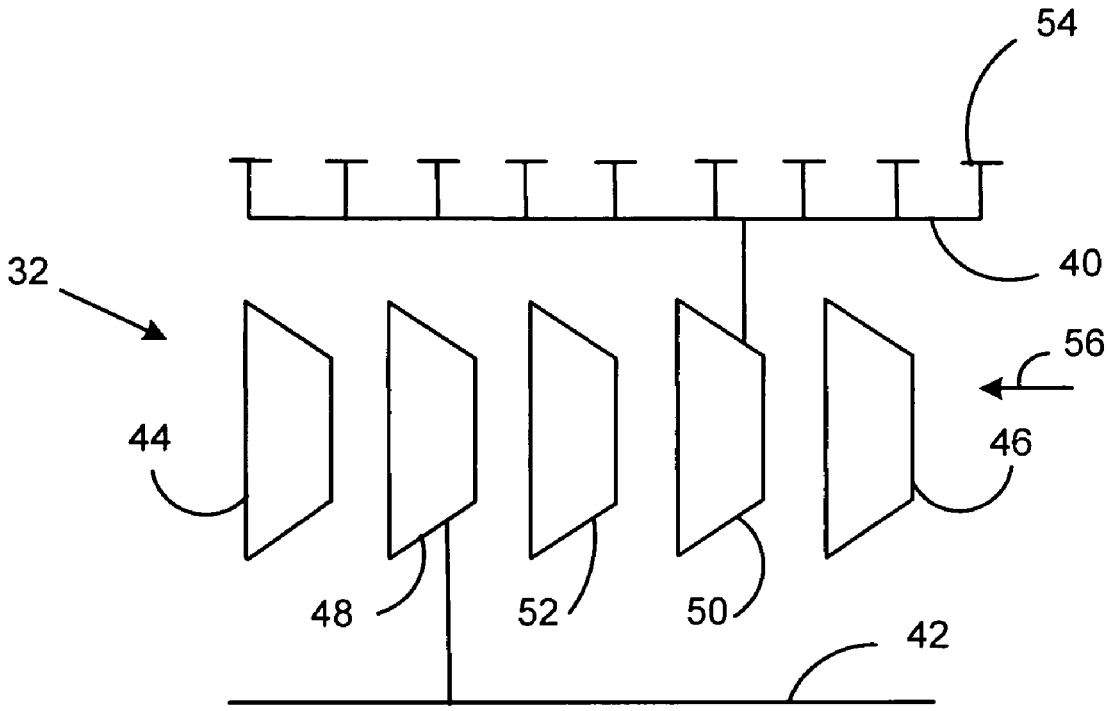
FIG. 3 illustrates in schematic form an optical shutter and conductive rails according to an embodiment of the present invention.

FIG. 3 illustrates in schematic form an optical shutter 32 in the form of a liquid crystal display and conductive rails 40, 42 according to an embodiment of the present invention. While the structure and operation of a liquid crystal display is well known in the art and need not be described in detail for an understanding of the present invention, a general description of the structure and operation will be provided. Optical shutter 32 includes a layer of nematic liquid crystals 52 sandwiched between two clear polarized substrates 44, 46, such as, for example, glass that has a polarizing film applied to the side facing outward away from the layer 52, oriented such that the polarizing films are in the same direction. The side of the substrate 44 that does not have the polarizing film (facing toward the layer 52) has microscopic grooves in the surface that are oriented at a ninety degree angle to the polarizing film. The side of the substrate 46 that does not have the polarizing film (facing toward the layer 52) has microscopic grooves in the surface that are in the same direction as the polarizing film. A common electrode plane 48, formed from, for example, indium-tin oxide, is provided on the side of the substrate 44 with the grooves. Common electrode plane 48 is connected to a first conductive rail 42. A segment electrode plane 50, which can also be formed, for example, from indium-tin oxide, is provided on the side of the substrate 46 with the grooves. Segment electrode plane 50 is connected to a second conductive rail 40 (described further below). The molecules of the first layer of nematic liquid crystals 52 closest to the substrate 44 will align with the groves in the substrate 44, thereby aligning at a ninety degree angle to the polarizing orientation of the substrate 44. Each successive layer of molecules of the nematic liquid crystals 52 will gradually twist until the uppermost layer closest to the substrate 46 is at a ninety-degree angle to the bottom layer, thereby matching the polarizing orientation of the substrate 46.

As light traveling in the direction indicated by the arrow 56 strikes the first substrate 46, it is polarized in the polarizing orientation of the substrate 46 and passed through. The molecules in each layer of the nematic liquid crystals 52 guide the light to each successive layer. As light passes through each molecule, the orientation of the light is changed to match the plane of each molecule. When the light reaches the final layer of molecules in the nematic liquid crystals 52, its orientation is at the same angle as the final layer of molecules, which is at a ninety degree angle to the polarizing orientation of the substrate 44. As such, the light will not pass through the substrate 44 and the optical shutter 32 will appear as a dark area, i.e., opaque. When a voltage is applied between the common electrode plane 48 and the segment electrode plane 50, thereby passing a current through the nematic liquid crystals 52, the nematic liquid crystals 52 will untwist. The untwisting of the nematic liquid crystals 52 will change the angle of the light passing through them, aligning the orientation of the light to match the polarizing orientation of the substrate 44. As such, with a voltage applied to the planes 48, 50, light will pass through the substrate 44 and the optical shutter 32 will appear transparent.

Figure 4:
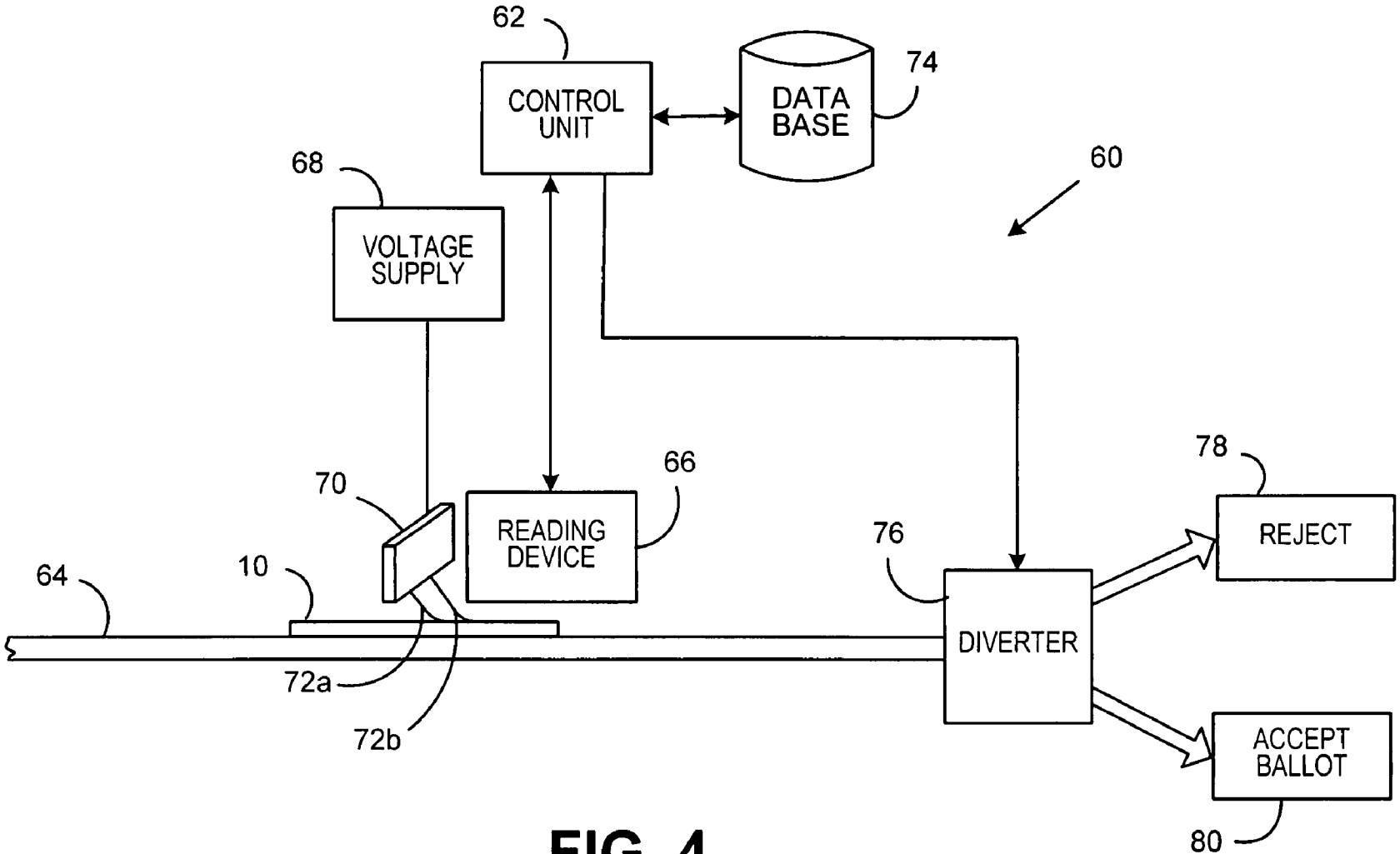
FIG. 4 illustrates in block diagram form a system for viewing the signature concealed using the envelope illustrated in FIGS. 1 and 2 according to an embodiment of the present invention.

The use of the conductive rails 40, 42 according to the present invention eliminates the need for individual power supplies associated with each optical shutter 32. The conductive rails 40, 42 can be utilized to provide the necessary power to the optical shutter 32 as the envelope 10 is being processed by automated processing equipment. The conductive rails 40, 42 are preferably applied to the surface of the substrate 46 or to the body portion 12 with connections to the applicable plane 48, 50. The conductive rail 40 is preferably provided with alternating contacts 54, the reason for which described below. FIG. 4 illustrates in block diagram form an automated system 60 for viewing the signature concealed using an optical shutter 32 and envelope 10 illustrated in FIGS. 1-3 according to an embodiment of the present invention. System 60 includes a control unit 62, such as, for example, a general or special purpose microprocessor or the like, that controls operation of the system 60. Control unit 62 is connected to a database 74, which is used to store voter information, including, for example, name, address, and a reference signature for use in verifying ballots received by mail as described below. A transport 64, such as, for example, rollers and/or belts, is used to transport a series of envelopes 10 (only one shown in FIG. 4) through the system 60. The speed of the transport 64 is preferably controlled by the control unit 62. A reading device 66, such as, for example, a scanner, camera, or the like is positioned adjacent to the transport 64 such that information provided on envelopes 10 being transported past the reading device 66 can be read therefrom. A diverter 76 is located downstream from the reading device 66 and is coupled to the control unit 62. Based on command signals from the control unit 62, the diverter 76 will divert each envelope to a reject path 78 or an accept ballot path 80 as described below.

The system 60 will apply a voltage from voltage supply source 68 to the optical shutter 32 of each envelope being transported therethrough, thereby rendering the optical shutter 32 transparent and allowing the reading device 66 to read each voter's signature located under the optical shutter 32. The voltage applied between the common electrode plane 48 and segment electrode plane 50 is preferably an AC RMS voltage with a minimal (approximately 50 mv or less) DC offset, as a DC voltage will cause damage to the nematic liquid crystals 52 which will eventually destroy them. Thus, the voltage source 68 may be an AC voltage source and the rails 40, 42 may be continuous rails. It is preferable to apply a square wave voltage signal to the common plane 48 and segment plane 50. While a purely AC signal (with no DC offset) can easily be generated, it is preferable for the voltage supply 68 to be a DC voltage source, that, coupled with the alternating contacts 54 of the conductive rail 40 (see FIG. 3), will result in the application of an AC square wave to the optical shutter 32. Voltage supply 68 is coupled to a pair of contacts 72*a*, 72*b* which are secured by a contact holder 70. The contacts 72*a*, 72*b* are preferably finger like projections that extend into the path of travel of the envelopes 10. The contacts 72*a*, 72*b* preferably include a biasing means, such as, for example, a spring or the like (not shown), to bias them towards the transport 64, thereby ensuring suitable contact between the contacts 72*a*, 72*b* and an envelope 10 passing underneath. Each contact 72*a*, 72*b* aligns with a respective conductive rail 40, 42 such that as the envelope 10 passes beneath the contact holder 70, the contacts 72*a*, 72*b* make a conductive connection to the conductive rails 40, 42 and allow voltage from the voltage supply 68 to be applied to the conductive rails 40, 42. The length of the alternating pattern of contacts 54, the space between each contact 54, and the speed of the transport 64 can be used to control the drive frequency of the square wave applied to each optical shutter 32. Preferably, the drive frequency is in the range of 40 to 60 Hz.

Figure 5:
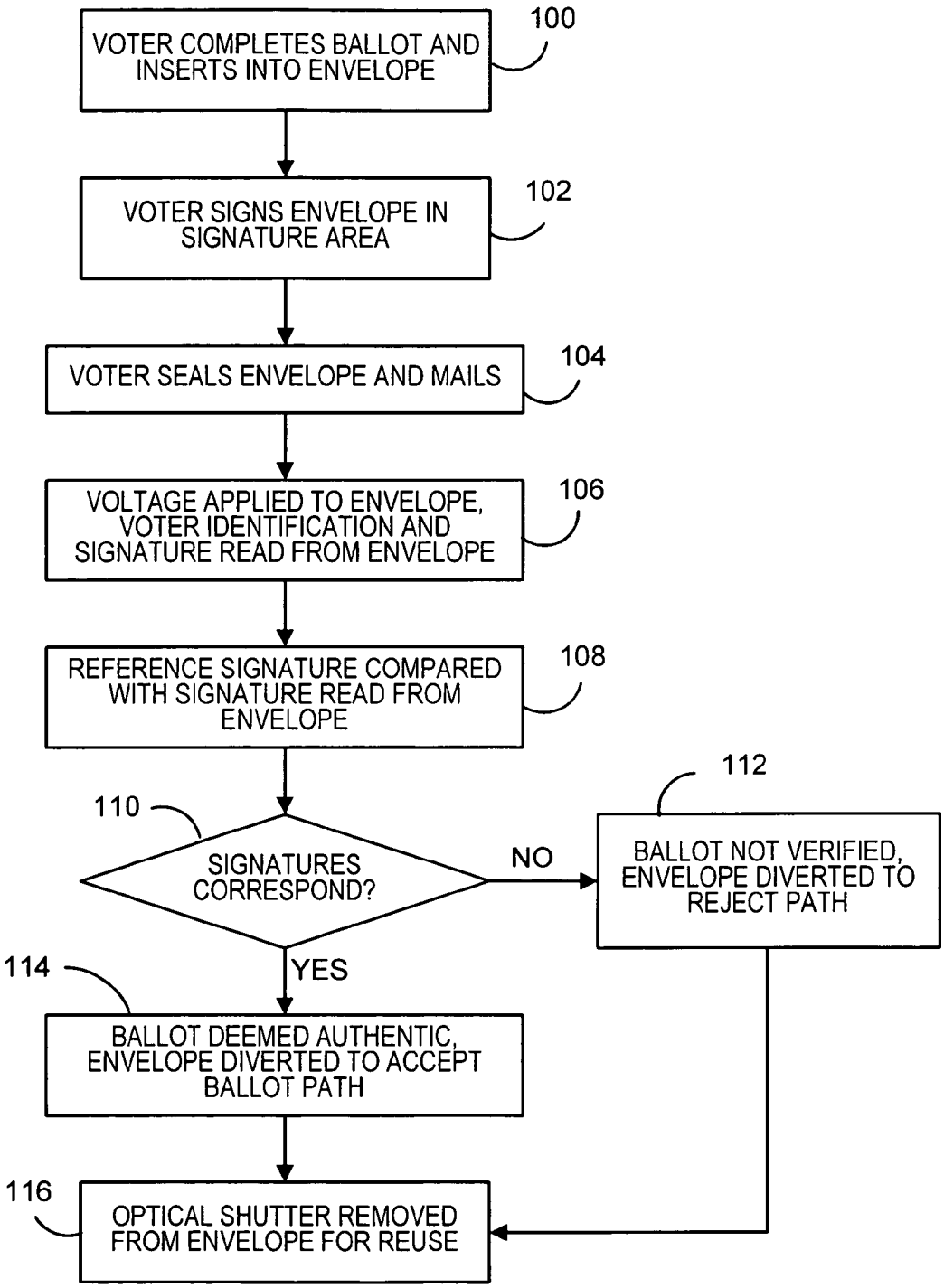
FIG. 5 illustrates in flow diagram form the preparation and processing of an envelope for mailing a ballot according to an embodiment of the present invention.

FIG. 5 illustrates in flow diagram form the preparation and processing of an envelope 10 for mailing a ballot according to an embodiment of the present invention. In step 100, a voter completes a ballot and inserts it into the pocket 18 of envelope 10. In step 102, the voter signs the envelope 10 in the signature area 20. In step 104, the voter seals the flap portion 14 to the body portion 12 of the envelope 10, thereby covering the identification area 22 and signature area 20 with the optical shutter 32, and mails the envelope 10 to the registrar's office. Since the optical shutter 32 is not provided with any power, it will appear opaque, as described above, and the signature and identification located in the areas 22 and 20 will be hidden from view. Thus, the privacy of the voter's signature is maintained during transit of the envelope 10 from the voter to the registrar's office.

Upon receipt of the envelope 10 at the registrar's office, in step 106 the envelope 10 is processed using the system as illustrated in FIG. 4. The envelope 10 is transported by the transport 64 and a voltage is applied to the conductive rails 40, 42 via the contacts 72*a*, 72*b*, thereby rendering the optical shutter 32 transparent as described above. The reading device 66 can then read the identification information in area 22 and the signature in area 20 from the envelope 10. In step 108, the control unit 62 will retrieve the reference signature from the database 74, based on the identification of the voter in area 22, and compare the reference signature to the signature read from area 20 of envelope 10. In step 110, it is determined if the reference signature retrieved from the data base 74 corresponds to the signature read from area 20 of envelope 10. If the signatures do not correspond, then in step 112 the ballot is rejected as not being verified and the envelope 10 is diverted by the diverter 76 to the reject path 78. Envelopes diverted to the reject path may be subject to some type of investigation to make a final determination if the vote should be counted or not. If in step 110 it is determined that the signatures do correspond, then in step 114 the ballot is deemed to be authentic and verified and the envelope 10 is diverted by the diverter 76 to the accept ballot path 80, in which the ballot will be given to ballot counters for tabulation. Preferably, the ballot is removed from the envelope 10 before being given to the ballot counters thereby maintaining a "secret ballot." Optionally, in step 116, the optical shutter 32 is removed from the envelope 10 (regardless of whether the vote was counted in step 114 or not counted in step 112) for reuse in subsequent elections.

Thus, according to the present invention, methods and systems that protect the privacy of signatures on ballots sent through the mail are provided. While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. An envelope comprising:

a body portion having a pocket for holding contents, the body portion including a predefined area for information to be provided on the body portion;

a flap portion connected to the body portion for covering the pocket when the flap portion is in a closed position, the flap portion including an opening that corresponds with the predefined area of the body portion when the flap is in the closed position such that the information in the predefined area is not covered by the flap portion;

an optical shutter covering the opening, the optical shutter having a first state in which the information in the predefined area is concealed and a second state in which the information in the predefined area is not concealed, the optical shutter changing from the first state to the second state upon application of a voltage signal to the optical shutter.

2. The envelope according to claim 1, wherein the predefined area includes an area for a person's signature.

3. The envelope according to claim 2, wherein the predefined area further includes an area for identification information of the person.

4. The envelope according to claim 1, wherein the optical shutter is a liquid crystal display.

5. The envelope according to claim 1, further comprising:

a first conductive trace coupled to the optical shutter; and a second conductive trace coupled to the optical shutter;

wherein the voltage signal is applied to the first and second conductive traces to change the optical shutter from the first state to the second state.

6. The envelope according to claim 5, wherein the second conductive trace includes a pattern of alternating contacts.

7. A system for processing an envelope, the envelope including information in a predefined area covered by an optical shutter, the optical shutter having a first state in which the information is concealed and a second state in which the information is not concealed, the optical shutter changing from the first state to the second state upon application of a voltage signal to conductive traces coupled to the optical shutter, the system comprising:

a transport for transporting the envelope through the system;

a power supply for supplying the voltage signal;

a plurality of electrical contacts coupled to the power supply and positioned such that each of the electrical contacts will make contact with a respective conductive trace as the envelope is transported past the electrical contacts to apply the voltage signal to the optical shutter to cause the optical shutter to change from the first state to the second state; and a reading device to read the information in the predefined area of the envelope when the optical shutter is in the second state and the information is not concealed.

8. The system according to claim 7, further comprising:

a control unit for comparing at least a portion of the information read from the envelope with reference information and generating a result; and a diverter device coupled to the control unit to divert the envelope to a selected path based on the result of the comparison of the information read from the envelope with the reference information.

9. The system according to claim 8, further comprising:

a data base coupled to the control unit, the data base storing the reference information.

10. The system according to claim 8, wherein the at least a portion of the information read from the envelope includes a signature and the reference information includes a reference signature.

11. A method for processing a ballot received from a voter in an envelope, the envelope including information associated with the voter that is covered by an optical shutter in a first state in which the signature is concealed, the method comprising:

applying a voltage signal to the optical shutter to cause the optical shutter to change from the first state to a second state in which the information is not concealed by the optical shutter;

reading the information from the envelope;

comparing the information read from the envelope with reference information to determine authenticity of the ballot; and if the information read from the envelope compares favorably with the reference information, accepting the ballot as authentic.

12. The method according to claim 11, wherein the information read from the envelope includes a signature of the voter and the reference information includes a reference signature.

13. The method according to claim 12, wherein the information read from the envelope further includes identification information associated with the voter; and the method further comprises:

obtaining the reference signature from a data base based on the identification information associated with the voter that is read from the envelope.

14. The method according to claim 11, wherein applying a voltage signal further comprises:

applying a DC voltage signal between a first conductive rail coupled to the optical shutter and a second conductive rail having a pattern of alternating contacts coupled to the optical shutter.

15. The method according to claim 11, further comprising:

removing the optical shutter from the envelope.

* * * * *